US007726085B2

(12) United States Patent
Winterowd et al.

(10) Patent No.: US 7,726,085 B2
(45) Date of Patent: Jun. 1, 2010

(54) SYSTEMS FOR ATTACHING WOOD PRODUCTS

(75) Inventors: Jack G. Winterowd, Puyallup, WA (US); Jerry D. Izan, Puyallup, WA (US); Naomi High, Yelm, WA (US); Michael N. Taylor, Tacoma, WA (US); Daniel V. Hanson, Auburn, WA (US); Amar N. Neogi, Kenmore, WA (US); Thomas F. Schulner, Tacoma, WA (US); Douglas R. Loates, Tacoma, WA (US)

(73) Assignee: Weyerhaeuser NR Company, Federal Way, WA (US)

( * ) Notice: Subject to any disclaimer, the term of this patent is extended or adjusted under 35 U.S.C. 154(b) by 1180 days.

(21) Appl. No.: 11/192,734

(22) Filed: Jul. 29, 2005

(65) Prior Publication Data

US 2007/0022709 A1 Feb. 1, 2007

(51) Int. Cl.
*E04C 1/00* (2006.01)

(52) U.S. Cl. ..... 52/309.5; 52/774; 52/592.1; 52/539; 428/48; 156/290; 156/313

(58) Field of Classification Search ..... 52/309.5, 52/313, 314, 589.1, 592.1, 539, 774, 775, 52/773; 428/48, 167, 47; 156/62, 250, 290, 156/280, 307.5, 313, 312, 309.6
See application file for complete search history.

(56) References Cited

U.S. PATENT DOCUMENTS

| | | | | |
|---|---|---|---|---|
| 5,755,068 | A * | 5/1998 | Ormiston | 52/314 |
| 5,813,180 | A * | 9/1998 | Whitney et al. | 52/270 |
| 6,546,679 | B1 * | 4/2003 | Bushberger | 52/169.14 |
| 6,578,332 | B2 * | 6/2003 | Bushberger | 52/293.3 |
| 6,772,569 | B2 * | 8/2004 | Bennett et al. | 52/592.1 |
| 7,182,988 | B2 * | 2/2007 | McCain | 428/40.2 |
| 2007/0026182 | A1 | 2/2007 | Winterowd et al. | |

* cited by examiner

*Primary Examiner*—Richard E Chilcot, Jr.
*Assistant Examiner*—Chi Q Nguyen

(57) ABSTRACT

Systems for attaching a plurality of wood products are provided. In a first type of system, a first wood product has a first chemical compound applied to a surface of the first wood product. A second wood product has a second chemical compound applied to a surface of the second wood product. An adduct is formed when the first chemical compound contacts the second chemical compound wherein the first wood product becomes adhered to the second wood product. In a second type of system, a pressure sensitive and/or anaerobic adhesive is placed on at least one of the wood products prior to assembly. The compounds/adhesives have an open assembly time greater than or approximately equal to 24 hours.

16 Claims, No Drawings

SYSTEMS FOR ATTACHING WOOD PRODUCTS

FIELD OF THE INVENTION

This invention relates generally to systems for attaching wood products. The systems have one or more chemical compounds applied to one or more of the wood products. The compound or compounds interact and/or react when the wood products come in contact with each other to enable adhesion between the wood products at ambient temperatures.

BACKGROUND OF THE INVENTION

It is common practice for buildings and/or residential structures to be comprised of discrete structural building materials, such as framing members and sheet goods. The building materials are typically connected by use of mechanical fasteners, such as nails, screws, staples. Other mechanical fasteners that may be used are plates, anchors, hangers, bolts, split rings and clips or the like. Adhesives are also used in combination with mechanical fasteners to help connect certain types of building materials. For example, liquid construction adhesives are commonly utilized in joist-to-subfloor panel connections to improve the strength and durability of these joints. In some cases, liquid construction adhesives are used in tongue-and-groove joints between adjacent subfloor panels. In other cases, certain liquid construction adhesives are applied to the interior face of wall studs prior to installation of interior sheetrock. The use of adhesives at the stud-to-sheetrock interface allows the builder to reduce the number of mechanical fasteners. The result may be an interior wall with fewer surface defects. In all of these cases, the construction adhesive is applied to the building material during the construction process.

In spite of the advantages associated with construction adhesives, their usage is somewhat limited, due in part to the difficulty and time required to apply them to building materials during the construction process. Although it is important for connections between building materials to be strong and highly durable, it is also important to have connections that are easy and relatively quick to assemble. In most cases, construction adhesives are applied to building materials at a job site with a manual dispensing device that is commonly referred to as a caulking gun. This device is relatively slow and labor intensive. In cold or freezing weather there is a tendency for the viscosity of liquid construction adhesives to increase, which makes them even more difficult to apply with a manual caulking gun. Thus, some builders choose not to use construction adhesives because of the time and difficulty associated with their use.

Conventional construction adhesives generally are designed to be applied to building materials at a specific spread rate, and for the joint to be closed within a certain period of "open assembly time". The "open-assembly-time" is the time between adhesive application to one or both substrates and the closing of the joint by mating with the corresponding substrate. Long "open-assembly-times" can result in partial or complete solidification of the applied adhesive prior to contact with the corresponding substrate in the joint. When this occurs the adhesive might not contribute anything to the strength of the joint, and in many cases it will obstruct the fit of the joint. Unfortunately, many builders or installers struggle to adhere to these requirements during the construction process, and the resulting joint strength and durability are less than that which was anticipated.

One specific example of a failure mode involves the application of adhesives to substrates in relatively hot, dry weather in a work environment requiring relatively long "open-assembly-times". Another failure mode associated with conventional construction adhesives relates to their use on building materials that are wet from exposure to rain or snow. It has been discovered that most known construction adhesives yield weaker joints when they are applied to wet building materials. Yet another failure mode relates to incomplete or non-uniform adhesive application rates. In this situation at least some portion of the joint substrate receives an insufficient amount of adhesive. Accordingly, there is a need for building materials that can be assembled without the application of construction adhesives at the job site, and yet yield high-strength, durable joints, even when assembled under adverse weather conditions.

DETAILED DESCRIPTION OF THE INVENTION

The present invention generally relates to systems for attaching wood products. The system may have a set of building materials with surface regions destined for joint formation that are treated with either latent adhesive or latent adhesive components. In an embodiment, one or more adhesives are placed on one or more of the wood products. The adhesive provides a mechanical bond when pressure is applied between the wood products at ambient temperatures. In another embodiment, two or more adhesives are applied to the wood products. The adhesives remain inert until they contact each other. At that point, an adduct is formed at ambient temperatures which enables adhesion between the wood products. Temperatures required for bond formation will generally range from 5 to 40 degrees Celsius. Thus, the adhesive system of the present invention may not require the use of heating devices, such as hot irons, in order to achieve bond formation.

In general, the wood products which may be suitable for the present invention may be those which will be incorporated into either floor, wall or roof segments of buildings, houses or dwellings, or the like. These building materials are incorporated into said structures through joints that are secured with either mechanical fasteners and/or adhesives. Examples of wood products suitable for this invention include framing members such as solid-sawn wooden lumber; engineered wood products, such as laminated veneer lumber, strand-based boards, composite veneer based boards, particleboard, medium density fiberboard, or the like; wood-plastic composite products; wood-based composite I-joists; glulam; finger-jointed lumber, metallic framing members, which are commonly referred to as "steel-studs"; or the like. Framing members are commonly used in support of floor, wall and roof structures as joists, rim boards, studs, trusses, headers, rafters, beams, columns, sill plates, posts, girders, blocking, cripples, trimmers, rough sill, top plate, inset bracing, or the like. Other building materials suitable for this invention are structural panels, which generally include OSB ("oriented strand board") and plywood. Panels are commonly used as sheathing and are attached to the framing members in floor, wall and roof structures. Other building materials appropriate for this invention may be, for example, metallic building materials. The systems of the present invention may improve the assembly and/or attachment of various types of joints, such as, for example, panel-to-panel, sill plate-to-foundation, rim board-to-sill plate, rim board-to-foundation, rim board-to-joist, girder-to-joist, joist-to-rim board, joist-to-blocking, joist-to-subfloor, sill plate-to-subfloor, corner post-to-stud, sheathing-to-stud, sheetrock-to-stud, trimmer-to-stud, header-to-stud, header-to-top plate, header-to-opening trim plate, rafter stud-to-top plate, rafter-to-ridge board, rafter-to-sheathing, rafter-to-decking, and collar beam-to-rafter.

Latent adhesives which may be appropriate for this invention include, in an embodiment, 1-component adhesives, such as pressure-sensitive adhesives or anaerobic adhesives. In another embodiment, multi-component adhesive systems may be used, such as honeymoon-type adhesive systems. Overall, the 1-component and multi-component adhesives are formulated to provide open assembly times greater than or approximately equal to 24 hours.

Pressure sensitive adhesives are comprised of film-forming elastomeric materials with low $T_g$ (glass-transition temperature) values (−40 to −60° C.). The pressure sensitive adhesives may also have one or more of the following: tackifiers, plasticizers, pigments, fillers and other compounds. Examples of elastomeric materials used in pressure sensitive adhesives include certain natural rubbers, styrene-butadiene polymers, butyl rubber, polyisoprene, polyisobutylene, polyvinyl ethers, silicones, ethylene vinyl acetate copolymers, and acrylic polymers. Tackifiers used in pressure sensitive adhesives may include rosin esters, terpenes and certain aromatic hydrocarbon low-molecular-weight resins.

Pressure sensitive adhesives appropriate for this invention may also include mixtures of epoxy solids and liquids. These mixtures can be conveniently processed in a factory-setting as hot-melt materials. Suitable epoxy solids may include epoxy novolacs, such as Epon SU-8 from Resolution Performance Products and D.E.R. 661 from the Dow Chemical Company. Epoxy solids which are novolac-free, such as Epon 1031 from Resolution Performance Products can also be used. Examples of suitable epoxy liquids are Epon 828 from Resolution Performance Products and D.E.R. 317 from the Dow Chemical Company. In some cases, it can be beneficial to react the epoxy with small amounts of amine or amide-based hardeners in order to increase the molecular weight of the resin. This may help to increase the eventual strength of the joint and/or retard the initial rate of bond formation when two substrates are placed in contact with each other. Examples of suitable epoxy hardeners include Epikure 3140 from Resolution Performance Products and D.E.H. 52 from the Dow Chemical Company. Ratios of epoxy solid to epoxy liquid that can be combined to form epoxy-based pressure sensitive adhesives suitable for this invention generally range from 1:6 to 6:1. When amine based hardeners are used, it is most convenient to combine epoxy liquid resin with hardener at a ratio of 15:1 to 50:1, and to mix well prior to adding epoxy solid resin. The entire mixture is then gently heated until the epoxy solid resin melts and dissolves in the other formulation components. Subsequent to an initial reaction period, these mixtures can be repeatedly heated to form low viscosity liquids and then cooled to form solids.

Latent adhesives based on anaerobic adhesives are typically comprised of acrylic monomers, acrylic resins and a free radical initiation system. Free radical polymerization of the monomers is inhibited by the presence of oxygen, but proceeds in the absence of oxygen. Thus, the anaerobic adhesive is applied to a region of a building material destined for joint formation. The applied adhesive will not cure as long as the joint remains open and the adhesive is exposed to air. Upon closing the joint, the applied adhesive will no longer be exposed to air, and the curing reaction will proceed. The application of cure accelerators, such as o-benzoic sulfimide (saccharin), to the corresponding substrate for joint formation might improve the reactivity of this adhesive system. An example of anaerobic adhesives is the commercially known "Speedbonder" from the Loctite Corporation.

Latent, two-component, honeymoon type adhesive systems are generally comprised of components 'A' and 'B'. In an embodiment, adhesive component 'A' is applied to a surface of a first wood product, or substrate, and adhesive component 'B' is applied to a surface of a second wood product, or substrate. These components may be applied in a variety of methods. For example, a component may be applied as a uniform coating, in a bead form, or a combination of both. The application may be continuous or discontinuous. A range for the application of component may be 0.1 to 30 grams per square foot.

When the first and second substrates are mated, component 'A' contacts component 'B', and a reaction between the two components yields a solid adduct with ability to transfer stresses between the two substrates. Moreover, the adduct enables adhesion and attachment between the substrates. Components 'A' and 'B' can be any combination of materials that 1) can each be applied to building materials in a factory; 2) can each exist on the building material in a relatively inert state for some prolonged period of storage time that is greater than 1 day at a storage temperature of 5-30° C., and 3) are reactive with each other subsequent to the storage time such that bond formation occurs between the two substrates as a result of chemical reactions between the previously applied 'A' and 'B' components. Examples of latent, two-component, honeymoon type adhesive systems are shown in Table 1.

TABLE 1

Examples of latent, two-component, honeymoon type adhesive systems

| SYSTEM NUMBER | COMPONENT 'A' | COMPONENT 'B' |
|---|---|---|
| 1 | Resorcinol/formaldehyde novolac resin | Paraformaldehyde |
| 2 | Resorcinol/formaldehyde novolac resin | Oxazolidine, such as 5-hydroxymethyl-1-aza-3,7-dioxabicyclo [3,3,0] octane; 5-ethyl-1-aza-3,7-dioxabicyclo [3,3,0] octane; or oxazolidine 4,4-dimethyl-1-oxa-3-azacyclopentane |
| 3 | Resorcinol/formaldehyde novolac resin | Trioxane |
| 4 | Resorcinol/formaldehyde novolac resin | Urea/formaldehyde resin with a molar ratio of formaldehyde/urea in excess of 1.0 |
| 5 | Resorcinol/formaldehyde novolac resin + ammonium chloride | Urea/formaldehyde resin with a molar ratio of formaldehyde/urea in excess of 1.0 |

TABLE 1-continued

Examples of latent, two-component, honeymoon type adhesive systems

| SYSTEM NUMBER | COMPONENT 'A' | COMPONENT 'B' |
|---|---|---|
| 6 | Resorcinol/formaldehyde novolac resin + aluminum chloride | Urea/formaldehyde resin with a molar ratio of formaldehyde/urea in excess of 1.0 |
| 7 | Resorcinol/formaldehyde novolac resin + ammonium sulfate | Urea/formaldehyde resin with a molar ratio of formaldehyde/urea in excess of 1.0 |
| 8 | Resorcinol/formaldehyde/ butyraldehyde novolac resin | Oxazolidine, such as 5-hydroxymethyl-1-aza-3,7-dioxabicyclo [3,3,0] octane; 5-ethyl-1-aza-3,7-dioxabicyclo [3,3,0] octane; or oxazolidine 4,4-dimethyl-1-oxa-3-azacyclopentane |
| 9 | Urea/formaldehyde resin with a molar ratio of formaldehyde/ urea less than 0.8 + ammonium sulfate | Urea/formaldehyde resin with a molar ratio of formaldehyde/urea in excess of 1.0 |
| 10 | Resorcinol/formaldehyde novolac resin | Melamine/formaldehyde resin with a molar ratio of formaldehyde/melamine in excess of 1.0 |
| 11 | Resorcinol/formaldehyde/ butyraldehyde novolac resin | Urea/formaldehyde resin with a molar ratio of formaldehyde/urea in excess of 1.0 |
| 12 | Epoxy resin | Polyamine |
| 13 | Epoxy resin | Polyamide |
| 14 | Multifunctional aromatic isocyanate | Polyol |
| 15 | Multifunctional aromatic isocyanate | Polyamine |
| 16 | Acrylic adhesive with chlorosulfonated polyethylene | Aniline/butyraldehyde adduct (see U.S. Pat. No. 3,890,407) |
| 17 | Polydimethylsiloxane | Tetraethoxysilane |

A similar, latent, two-component, honeymoon type adhesive system, in another embodiment, is also based on components 'A' and 'B', which are applied, for example, as beads (A-B-A) onto a region of a building material substrate that is destined for joint formation. In this embodiment, the applied components in bead form remain until substrates are mated, and joint formation results in mixing of the 'A' and 'B' components. Adhesive components suitable for this version of the invention are typically elements of a reactive acrylic adhesive system, such as that known as Product 3273 A&B, which is produced by Loctite Corporation.

In an embodiment, the latent adhesives and latent adhesive components may be fortified with various additives such as colorants, opacifying agents, diluents, viscosity increasing agents, preservatives, plasticizers, fillers, buffers, surfactants, foaming agents and other compounds which might improve formula properties related to storage, application, processing, appearance, cost, substrate interactions and bond formation. The additive or additives may represent 0-80% of the total formulation.

In an embodiment, the latent adhesives may be covered with a film and/or release paper. Release films that would be suitable for application to substrate surfaces that are treated with adhesives would be a polyethylene or a polypropylene film filled with titanium dioxide to achieve opacity and coated with a silicone release agent. A commercial example is known as S/l/S White and is manufactured by Griff Specialty Paper and Film Company. The release film should be sufficiently thin and flexible in order to allow it to be peeled off of the substrate, but it must be strong enough not to break or tear as it is being removed. A textured, slip-resistant, film may have certain advantages in applications involving potential foot traffic, such as joist surfaces. The film may be used in conjunction with 2-component systems and/or 1-component systems which utilize pressure-sensitive adhesives. In addition, the film may prevent an individual from contacting the adhesive component(s) directly. The film may also prevent contaminants from becoming attracted to the adhesive component(s). In addition, the film may allow multiple wood products to be stacked prior to assembly while preventing unwanted adhesion between them.

The invention is further illustrated by the following examples:

EXAMPLE 1

A resorcinol/formaldehyde novolac resin known as 42-14732 was prepared in the following manner: A 2 L reactor was charged with resorcinol (770.7 g; 7.0 moles), 50% sodium hydroxide solution (20.0 g) and water (750 g). The mixture was stirred and heated to a temperature of 60° C. in order to yield a solution. This solution was maintained at a temperature of 60° C. and 37% formalin (324.0 g; 4.0 moles) was continuously added by use of an addition funnel over a period of 1 hour. The mixture was then stirred and maintained at a temperature of 60° C. for the next 2 hours. An aliquot of 50% sodium hydroxide solution (20.0 g) was then added to the resin with continuous stirring and the mixture was cooled to 25° C. This resin had a Gardner-Holdt viscosity of 57 cps at 25° C., a percent solids value of 45.3%, a specific gravity of 1.140 and a pH value of 6.5.

An adhesive component known as 'A' (101) was prepared by charging a 400 mL beaker with resorcinol/formaldehyde novolac resin 42-14732 (139.5 g); a black dye known as Reactint Black X95AB (0.5 g), which was produced by Milliken Chemical; triethanolamine (24.0 g); bisphenol 'A' (16.0 g); and a fumed silica known as Sipernat 50S (20.0 g), which was produced by the Degussa Corporation. These components were manually stirred subsequent to each addition to yield a black, homogenous, stable formula with a melting point of about 40° C.

An adhesive component known as 'B' (100) was prepared by charging a 400 mL beaker with glycerol (70.0 g); a urea/formaldehyde resin known as 240A16 (22.0 g), which was produced by the Georgia-Pacific Resins Corporation; a yellow pigment dispersion known as Flexiverse YFD 2193 (6.6 g), which was produced by the Sun Chemical Corporation; a blue pigment dispersion known as Sunsperse BHD 6000 (1.4 g), which was produced by the Sun Chemical Corporation;

and powdered paraformaldehyde (100.0 g), which was produced by the Hoechst Celanese Corporation. These components were manually stirred to yield a green, stable, viscous fluid.

An adhesive component known as 'B' (101) was prepared by charging a 400 mL beaker with glycerol (60.0 g); a yellow pigment dispersion known as Flexiverse YFD 2193 (6.6 g), which was produced by the Sun Chemical Corporation; a blue pigment dispersion known as Sunsperse BHD 6000 (1.4 g), which was produced by the Sun Chemical Corporation; an oxazolidine solution known as Zoldine ZT-65 (106.0 g), which was produced by the Angus Chemical Company; and Sipemat 50S (26.0 g), which was produced by the Degussa Corporation. These components were manually stirred to yield a green, stable, viscous fluid.

An adhesive component known as 'B' (102) was prepared by charging a 400 mL beaker with trioxane (20.0 g) and water (120.0 g). The mixture was stirred and heated to a temperature of about 60° C. in order to dissolve the trioxane. The mixture was further supplemented with glycerol (26.0 g); a yellow pigment dispersion known as Flexiverse YFD 2193 (6.6 g), which was produced by the Sun Chemical Corporation; a blue pigment dispersion known as Sunsperse BHD 6000 (1.4 g), which was produced by the Sun Chemical Corporation; and Sipemat 50S (26.0 g), which was produced by the Degussa Corporation. These components were manually stirred to yield a green, stable, viscous fluid.

Four OSB flooring panels, which were produced by the Weyerhaeuser Company, were cut into multiple sections (6"×48"). Some of these sections were routed on one long edge to yield a tongue-shaped profile. Other sections were routed on one long edge to yield a groove-shaped profile. All of the long, profiled sections were then cut to yield sections that were 6"×6" in size that had one edge with either a tongue or a groove-shaped profile.

Adhesive component 'A' (101) was heated to a temperature of about 60-70° C. and applied to the tongue-shaped edge of sections (12 count) at a spread rate of about 4 g/ft. Likewise, a portion of adhesive component 'B' (100) was loaded into a 60 mL syringe and extruded into the groove-shaped cavity on the edge of OSB sections (4 count) at a spread rate of about 4 g/ft. Also, a portion of adhesive component 'B' (101) was loaded into a 60 mL syringe and extruded into the groove-shaped cavity on the edge of OSB sections (4 count) at a spread rate of about 4 g/ft. Lastly, a portion of adhesive component 'B' (102) was loaded into a 60 mL syringe and extruded into the groove-shaped cavity on the edge of OSB sections (4 count) at a spread rate of about 4 g/ft. All types of treated OSB sections were stored at a temperature of 20° C. and a relative humidity value of 50% for a period of 0, 7, 14, 21, or 28 days in an undisturbed condition. Subsequent to the storage period corresponding tongue and groove-shaped edges were mated and held together by use of clamps for a period of 7 days at a temperature of 20° C. Specifically, samples with tongue edges treated with component 'A' (101) were mated with samples with groove sections treated with component 'B' (100). Also, samples with tongue edges treated with component 'A' (101) were mated with samples with groove sections treated with component 'B' (101). Also, samples with tongue edges treated with component 'A' (101) were mated with samples with groove sections treated with component 'B' (102). After the 7-day bond-formation period each assembly was unclamped and cut into strip tensile specimens (1.0" wide and 11.0" long) oriented perpendicular to the T&G ("tongue and groove") joints. Each specimen was then conditioned for 7 days at 20° C. and 50% relative humidity and then subjected to tensile strength measurements with the tensile stresses applied perpendicular to the T&G joint. All specimens failed at the T&G joint. The average tensile strength as a function of storage time and adhesive type is shown in Table 2.

TABLE 2

| | Tensile strength values of OSB T&G joints | | |
|---|---|---|---|
| SAMPLE STORAGE TIME (DAYS) | AVERAGE TENSILE STRENGTH (PSI) OF JOINTS BASED COMPONENTS 'A' (101) AND 'B' (100) | AVERAGE TENSILE STRENGTH (PSI) OF JOINTS BASED COMPONENTS 'A' (101) AND 'B' (101) | AVERAGE TENSILE STRENGTH (PSI) OF JOINTS BASED COMPONENTS 'A' (101) AND 'B' (102) |
| 0 | $150.3^{a}$ (39.5) | $105.0^{b}$ (40.3) | $63.5^{ce}$ (39.2) |
| 7 | $44.3^{eh}$ (20.2) | $60.7^{cd}$ (24.5) | $15.8^{g}$ (12.5) |
| 14 | $68.8^{c}$ (20.5) | $101.1^{b}$ (35.5) | $43.2^{eh}$ (22.6) |
| 21 | $50.8^{deh}$ (26.7) | $70.5^{c}$ (24.6) | $21.8^{fg}$ (11.2) |
| 28 | $29.3^{fh}$ (18.8) | $72.4^{c}$ (30.8) | $36.1^{h}$ (25.5) |

Note:
numbers shown in parenthesis are standard deviation values. Each average tensile strength value is based on 20 different measurements. Any two average strength values in Table 2 that do not share a common superscript were found to be significantly ($p < 0.05$) distinct based on a two-tailed Student's 't' test [see A. S. C. Ehrenberg (1978) Data Reduction: Analyzing and Interpreting Statistical Data, John Wiley & Sons, New York, NY, p 302.].

EXAMPLE 2

A urea/formaldehyde resin known as 10-14731 was prepared in the following manner: A 2 L reactor was charged with water (500 g); 91% paraformaldehyde prill (395.6 g; 12.0 moles), which was obtained from Spectrum Chemicals & Laboratory Products; urea prill (240.0 g; 4.0 moles); and triethanolamine (6.0 g). The mixture was stirred and heated to a temperature of 80° C. during the first 30 minutes to yield a solution. This solution was maintained at a temperature of 80° C. for a period of 90 minutes with continuous stirring. The temperature of the mixture was increased to 102° C. and this elevated temperature was maintained for a period of 5 minutes. The clear, colorless solution was then cooled to 60° C. and an aqueous 35% ammonium sulfate solution (15.0 g) was added to the resin by use of an addition funnel over a 5 minute period with continuous stirring. The mixture was maintained at a temperature of 60° C. for a period of 30 minutes, and was then cooled to 40° C. and charged with more triethanolamine (10.0 g) and then urea (300.0 g; 5.0 moles). With continued stirring the urea dissolved and the mixture was cooled to 20° C. This resin had a Gardner-Holdt viscosity of 49 cps at 25° C., a percent solids value of 52.7%, a specific gravity of 1.23 and a pH value of 7.5.

An adhesive component known as 'A' (5) was prepared by charging a 100 mL beaker with polymeric methylene bis diphenyl diisocyanate ("pMDI") (36.0 g) known as Mondur 541, which was produced by the Bayer Corporation; benzyl butyl phthalate (4.0 g); and fumed silica known as Cab-O-Sil EH-5 (1.0 g), which was produced by the Cabot Corporation. These components were manually stirred to yield a brown, viscous fluid.

An adhesive component known as 'B' (6) was prepared by charging a 100 mL beaker with UF resin 10-14731 (40.0 g); m-phenylenediamine (5.0 g); and fumed silica known as Cab-O-Sil EH-5 (2.0 g), which was produced by the Cabot Corporation. These components were manually stirred to yield a yellow, viscous fluid.

An OSB flooring panel which was produced by the Weyerhaeuser Company was cut into multiple sections (6"×48"). Some of these sections were routed on one long edge to yield a tongue-shaped profile. Other sections were routed on one long edge to yield a groove-shaped profile. All of the long, profiled sections were then cut to yield sections that were 6"×6" in size that had one edge with either a tongue or a groove-shaped profile.

Adhesive component 'A' (5) was applied to the groove-shaped edge of sections (4 count) at a spread rate of about 3 g/ft. Likewise, a portion of adhesive component 'B' (6) was applied to the tongue-shaped edge of sections (4 count) at a spread rate of about 3 g/ft. Both types of treated OSB sections were stored at a temperature of 20° C. and a relative humidity value of 50% for a period of 7 days in an undisturbed condition. Subsequent to the storage period corresponding tongue and groove-shaped edges were mated and held together by use of clamps for a period of 3 days at a temperature of 20° C. Specifically, samples with tongue edges treated with component 'B' (6) were mated with samples with groove sections treated with component 'A' (5). After the 3-day bond-formation period each assembly was unclamped and was found to be well bonded.

EXAMPLE 3

A melamine/urea/formaldehyde resin known as 22-14731 was prepared in the following manner: A 2 L reactor was charged with water (400 g); 91% paraformaldehyde prill (395.6 g; 12.0 moles), which was obtained from Spectrum Chemicals & Laboratory Products; urea prill (240.0 g; 4.0 moles); melamine (126.1 g; 1.0 moles); and triethanolamine (6.0 g). The mixture was stirred and heated to a temperature of 80° C. during the first 30 minutes to yield a solution. This solution was maintained at a temperature of 80° C. for a period of 60 minutes with continuous stirring. The clear, colorless solution was then cooled to 55° C. and an aqueous 35% ammonium sulfate solution (20.0 g) was added to the resin by use of an addition funnel over a 5 minute period with continuous stirring. The mixture was maintained at a temperature of 55° C. for a period of 40 minutes, and was then cooled to 40° C. and charged with more triethanolamine (12.0 g) and then urea (300.0 g; 5.0 moles). With continued stirring the urea dissolved and the mixture was cooled to 20° C. This resin had a Gardner-Holdt viscosity of 94 cps at 25° C., a percent solids value of 62.5%, a specific gravity of 1.256 and a pH value of 8.5.

A primer was prepared by combining and mixing pMDI known as Rubinate 1840 (100.0 g), which was produced by Huntsman Polyurethanes; and triacetin (100.0 g).

An adhesive component known as 'A' (15) was prepared by charging a 250 mL beaker with MUF resin 22-14731 (40.0 g); an oxazolidine solution (40.0 g) known as ZT-65, which was produced by the Angus Chemical Company; and glycerol (2.0 g). These components were manually stirred to yield a colorless, low-viscosity fluid.

An adhesive component known as 'B' (16) was prepared by charging a 250 mL beaker with MUF resin 22-14731 (40.0 g); urea (10.0 g); aqueous 35% ammonium sulfate solution (15.0 g); glycerol (2.0 g); and fumed silica known as Cab-O-Sil EH-5 (3.0 g), which was produced by the Cabot Corporation. These components were manually stirred to yield a colorless, viscous fluid.

An OSB flooring panel which was produced by the Weyerhaeuser Company was cut into multiple sections (6"×48"). Some of these sections were routed on one long edge to yield a tongue-shaped profile. Other sections were routed on one long edge to yield a groove-shaped profile. All of the long, profiled sections were then cut to yield sections that were 6"×6" in size that had one edge with either a tongue or a groove-shaped profile.

Primer was sprayed onto both tongue-shaped and groove-shaped OSB edges at an application rate of 0.5 g/ft. These samples were then stored at 20° C. and 50% relative humidity for a period of 4 hours prior to further treatment.

Adhesive component 'A' (15) was applied to the primed, groove-shaped edge of sections (4 count) at a spread rate of about 3 g/ft. Likewise, a portion of adhesive component 'B' (16) was applied to the primed, tongue-shaped edge of sections (4 count) at a spread rate of about 3 g/ft. Both types of treated OSB sections were stored at a temperature of 20° C. and a relative humidity value of 50% for a period of 7 days in an undisturbed condition. Subsequent to the storage period corresponding tongue and groove-shaped edges were mated and held together by use of clamps for a period of 10 days at a temperature of 20° C. Specifically samples with tongue edges treated with component 'B' (16) were mated with samples with groove sections treated with component 'A' (15). After the 10-day bond-formation period each assembly was unclamped and was found to be well bonded.

EXAMPLE 4

An adhesive component known as 'A' (23) was prepared by charging a 400 mL beaker with a pMDI known as Rubinate 1840 (70.0 g), which was produced by Huntsman Polyurethanes; and SynFac 8009, an aromatic polyether-based polyol (35.0 g), which was produced by Milliken Chemical. This mixture was stirred and heated to a temperature of 150° C. It was then cooled to 20° C. to yield a colorless, clear, tacky solid. The material had a viscosity that was less than 2000 cps when it was heated to 60° C.

An adhesive component known as 'B' (24) was prepared by charging a 400 mL beaker with Rubinate 1840 (22.0 g), which was produced by Huntsman Polyurethanes; and SynFac 8009 polyol (80.0 g), which was produced by Milliken Chemical. This mixture was stirred and heated to a temperature of 150° C. It was then cooled to 20° C. to yield a colorless, clear, tacky solid. The material had a viscosity that was less than 2000 cps when it was heated to 120° C.

An OSB flooring panel which was produced by the Weyerhaeuser Company was cut into multiple sections (6"×48"). Some of these sections were routed on one long edge to yield a tongue-shaped profile. Other sections were routed on one long edge to yield a groove-shaped profile. All of the long, profiled sections were then cut to yield sections that were 6"×6" in size that had one edge with either a tongue or a groove-shaped profile.

A solution comprised of toluene (30.0 g) and adhesive component 'A' (23) (30.0 g) was applied to the groove-shaped edge of sections (4 count) at a spread rate of about 2-3 g/ft. The toluene was allowed to evaporate and the treated surface was covered with a plastic film. Likewise, a solution comprised of toluene (30.0 g) and adhesive component 'B' (24) (30.0 g) was applied to the tongue-shaped edge of sections (4 count) at a spread rate of about 2-3 g/ft. Both types of treated OSB sections were stored at a temperature of 20° C. and a relative humidity value of 50% for a period of 3 days in an undisturbed condition. Subsequent to the storage period, the plastic film was removed from the groove-shaped OSB edges and corresponding tongue and groove-shaped edges were mated and held together by use of clamps for a period of 12 hours at a temperature of 20° C. Specifically, samples with tongue edges treated with component 'B' (24) were mated with samples with groove sections treated with component 'A' (23). After the 12-hour bond-formation period each assembly was unclamped and was found to be well bonded.

EXAMPLE 5

An adhesive component known as '111A' was prepared in the following manner: A 600 mL beaker was charged with an epoxy hardener known as Epikure 3140 (225.6 g), which was produced by Resolution Performance Products; and an epoxy resin known as Epon 828 (55.5 g) which was produced by Resolution Performance Products. The mixture was stirred manually and heated to 65° C. and maintained at this temperature for about 2 minutes. A polyamide resin known as Elvamide 8066 (40.1 g) was then added to the beaker and the mixture was heated to a temperature of 130° C. and stirred in order to disperse the Elvamide 8066. The beaker was then charged with an ethylene vinylacetate copolymer known as Elvax W210 (80.0 g), which was produced by E.I. du Pont de Nemours and Company. The mixture was heated to a temperature of 140° C. and stirred in order to disperse the Elvax W210. This mixture was then cooled to form a soft, sticky solid.

An adhesive component known as '111B' was prepared in the following manner: A 600 mL beaker was charged with an epoxy resin known as Epon 1031 (150.1 g), which was produced by Resolution Performance Products; and an epoxy resin known as Epon 828 (75.2 g) which was produced by Resolution Performance Products. The mixture was stirred manually and heated to 140° C. This mixture was then cooled to form a soft, sticky solid.

An OSB flooring panel which was produced by the Weyerhaeuser Company was cut into multiple sections (6"×48"). Some of these sections were routed on one long edge to yield a tongue-shaped profile. Other sections were routed on one long edge to yield a groove-shaped profile. All of the long, profiled sections were then cut to yield sections that were 6"×6" in size that had one edge with either a tongue or a groove-shaped profile.

Adhesive component 111A and sections of OSB with groove-shaped edges were both heated to a temperature of about 100° C. Hot adhesive component 111A was then applied to hot, groove-shaped edges on OSB sections (20 count) at a spread rate of about 2-4 g/ft. Likewise, adhesive component 111B and sections of OSB with tongue-shaped edges were both heated to a temperature of about 100° C. Hot adhesive component 111B was then applied to hot, tongue-shaped edges on OSB sections (20 count) at a spread rate of about 2-4 g/ft. Both types of treated OSB sections were allowed to cool and were stored at a temperature of 20° C. and a relative humidity value of 50% for a period of 0, 7, 14, 28, or 56 days in an undisturbed condition. Subsequent to the storage period, corresponding tongue and groove-shaped edges were mated and held together by use of clamps for a period of 7 days at a temperature of 20° C. Specifically samples with tongue edges treated with component 111B were mated with samples with groove sections treated with component 111A. After the 7-day bond-formation period each assembly was unclamped and cut into strip tensile specimens (1.0" wide and 11.0" long) oriented perpendicular to the T&G joints. Each specimen was then conditioned for 7 days at 20° C. and 50% relative humidity and then subjected to tensile strength measurements with the tensile stresses applied perpendicular to the T&G joint. All specimens failed at the T&G joint. The average tensile strength as a function of storage time is shown in Table 3.

TABLE 3

Tensile strength values of OSB T&G joints

| SAMPLE STORAGE TIME (DAYS) | AVERAGE TENSILE STRENGTH (PSI) OF JOINTS BASED ON COMPONENTS 111A AND 111B |
|---|---|
| 0 | $112.8^{ac}$ (21.0) |
| 7 | $99.9^{a}$ (27.9) |
| 14 | $72.0^{b}$ (18.7) |
| 28 | $128.0^{cd}$ (27.1) |
| 56 | $151.6^{d}$ (26.9) |

Note:
numbers shown in parenthesis are standard deviation values. Each average tensile strength value is based on 20 different measurements. Any two average strength values in Table 3 that do not share a common superscript were found to be significantly ($p < 0.05$) distinct based on a two-tailed Student's 't' test [see A. S. C. Ehrenberg (1978) Data Reduction: Analyzing and Interpreting Statistical Data, John Wiley & Sons, New York, NY, p 302.].

EXAMPLE 6

An adhesive component known as '113A' was simply comprised of an epoxy hardener known as Epikure 3140, which was produced by Resolution Performance Products.

An adhesive component known as '113B' was prepared in the following manner: A 600 mL beaker was charged with an epoxy resin known as Epon 1031 (150.1 g), which was produced by Resolution Performance Products; and an epoxy resin known as Epon 828 (75.2 g) which was produced by Resolution Performance Products. The mixture was stirred manually and heated to 140° C. This mixture was then cooled to form a soft, sticky solid.

An OSB flooring panel which was produced by the Weyerhaeuser Company was cut into multiple sections (6"×48"). Some of these sections were routed on one long edge to yield a tongue-shaped profile. Other sections were routed on one long edge to yield a groove-shaped profile. All of the long, profiled sections were then cut to yield sections that were 6"×6" in size that had one edge with either a tongue or a groove-shaped profile.

Sections of OSB with groove-shaped edges were heated to a temperature of about 100° C. Adhesive component 113A was then applied to hot, groove-shaped edges on OSB sections (4 count) at a spread rate of about 2-4 g/ft. Adhesive component 113B and sections of OSB with tongue-shaped edges were both heated to a temperature of about 100° C. Hot adhesive component 113B was then applied to hot, tongue-shaped edges on OSB sections (4 count) at a spread rate of about 2-4 g/ft. Both types of treated OSB sections were allowed to cool and were stored at a temperature of 20° C. and a relative humidity value of 50% for a period of 7 days in an undisturbed condition. Subsequent to the storage period corresponding tongue and groove-shaped edges were mated and held together by use of clamps for a period of 7 days at a temperature of 20° C. Specifically samples with tongue edges treated with component 113B were mated with samples with groove sections treated with component 113A. After the 7-day bond-formation period each assembly was unclamped and cut into strip tensile specimens (1.0" wide and 11.0" long) oriented perpendicular to the T&G joints. Each specimen was then conditioned for 7 days at 20° C. and 50% relative humidity and then subjected to tensile strength measurements with the tensile stresses applied perpendicular to the T&G joint. All specimens failed at the T&G joint. The average tensile strength was 116.7 psi and the standard deviation was 61.9 psi.

EXAMPLE 7

An adhesive known as '115' was prepared in the following manner: A 600 mL beaker was charged with an epoxy resin known as Epon 1031 (60.0 g), which was produced by Resolution Performance Products; and an epoxy resin known as Epon 828 (40.0 g) which was produced by Resolution Performance Products. The mixture was stirred manually and heated to 140° C. This mixture was then cooled to form a soft, sticky solid.

An OSB flooring panel which was produced by the Weyerhaeuser Company was cut into multiple sections (6"×48"). Some of these sections were routed on one long edge to yield a tongue-shaped profile. Other sections were routed on one long edge to yield a groove-shaped profile. All of the long, profiled sections were then cut to yield sections that were 6"×6" in size that had one edge with either a tongue or a groove-shaped profile.

Adhesive 115 and sections of OSB with groove-shaped edges were both heated to a temperature of about 80° C. Hot adhesive component 115 was then applied to hot, groove-shaped edges on OSB sections (16 count) at a spread rate of about 2-4 g/ft. Likewise, adhesive component 115 and sections of OSB with tongue-shaped edges were both heated to a temperature of about 80° C. Hot adhesive component 115 was then applied to hot, tongue-shaped edges on OSB sections (16 count) at a spread rate of about 2-4 g/ft. Both types of treated OSB sections were allowed to cool and were stored at a temperature of 20° C. and a relative humidity value of 50% for a period of 0, 14, 28, or 56 days in an undisturbed condition. Subsequent to the storage period corresponding tongue and groove-shaped edges were mated and held together by use of clamps for a period of 7 days at a temperature of 20° C. Specifically, samples with tongue edges treated with adhesive 115 were mated with samples with groove sections treated with adhesive 115. After the 7-day bond-formation period each assembly was unclamped and cut into strip tensile specimens (1.0" wide and 11.0" long) oriented perpendicular to the T&G joints. Each specimen was then conditioned for 7 days at 20° C. and 50% relative humidity and then subjected to tensile strength measurements with the tensile stresses applied perpendicular to the T&G joint. All specimens failed at the T&G joint. The average tensile strength as a function of storage time is shown in Table 4.

TABLE 4

Tensile strength values of OSB T&G joints

| SAMPLE STORAGE TIME (DAYS) | AVERAGE TENSILE STRENGTH (PSI) OF JOINTS BASED ON ADHESIVE 115 |
|---|---|
| 0 | $48.5^{a}$ (14.8) |
| 14 | $102.1^{bc}$ (33.0) |
| 28 | $108.8^{b}$ (20.8) |
| 56 | $86.7^{c}$ (38.5) |

Note:
numbers shown in parenthesis are standard deviation values. Each average tensile strength value is based on 20 different measurements. Any two average strength values in Table 4 that do not share a common superscript were found to be significantly ($p < 0.05$) distinct based on a two-tailed Student's 't' test [see A. S. C. Ehrenberg (1978) Data Reduction: Analyzing and Interpreting Statistical Data, John Wiley & Sons, New York, NY, p 302.].

EXAMPLE 8

An adhesive known as '116' was prepared in the following manner: A 600 mL beaker was charged with an epoxy resin known as Epon 1031 (55.0 g), which was produced by Resolution Performance Products; and an epoxy resin known as Epon 828 (45.0 g) which was produced by Resolution Performance Products. The mixture was stirred manually and heated to 140° C. This mixture was then cooled to form a soft, sticky solid.

An adhesive known as '117' was prepared in the following manner: A 600 mL beaker was charged with an epoxy resin known as Epon 1031 (60.0 g), which was produced by Resolution Performance Products; and an epoxy resin known as Epon 828 (40.0 g) which was produced by Resolution Performance Products. The mixture was stirred manually and heated to 140° C. This mixture was then cooled to form a soft, sticky solid.

An adhesive known as '118' was prepared in the following manner: A 600 mL beaker was charged with an epoxy resin known as Epon 1031 (65.0 g), which was produced by Resolution Performance Products; and an epoxy resin known as Epon 828 (35.0 g) which was produced by Resolution Performance Products. The mixture was stirred manually and heated to 140° C. This mixture was then cooled to form a soft, sticky solid.

An OSB flooring panel which was produced by the Weyerhaeuser Company was cut into multiple sections (6"×6") and each of these had four square edges.

Adhesive 116 and OSB sections were both heated to a temperature of about 80° C. Hot adhesive 116 was then applied to one square edge of hot OSB sections (8 count) at a spread rate of about 4 g/ft. Likewise, adhesive 117 and OSB sections were both heated to a temperature of about 80° C. Hot adhesive 117 was then applied to one square edge of hot OSB sections (8 count) at a spread rate of about 4 g/ft. Lastly, adhesive 118 and OSB sections were both heated to a temperature of about 80° C. Hot adhesive 118 was then applied to one square edge of hot OSB sections (8 count) at a spread rate of about 4 g/ft. All types of treated OSB sections were allowed to cool and were stored at a temperature of 20° C. and a relative humidity value of 50% for a period of 7 or 28 days in an undisturbed condition. Subsequent to the storage period corresponding adhesive-treated square edges were mated and held together by use of clamps for a period of 1 day at a temperature of 20° C. Specifically, samples with square edges treated with adhesive 116 were mated to samples with square edges treated with adhesive 116. Likewise, samples with square edges treated with adhesive 117 were mated to samples with square edges treated with adhesive 117. Lastly, samples with square edges treated with adhesive 118 were mated to samples with square edges treated with adhesive 118. After the 1-day bond-formation period each assembly was unclamped and cut into 5 notched shear-block specimens (bond area=1.0"×0.75"). Each specimen was then conditioned for 7 days at 20° C. and 50% relative humidity and then subjected to compression shear strength measurements at a displacement rate of 0.2 inch/minute. All specimens failed at the adhesive joint. The average shear strength as a function of storage time and adhesive type is shown in Table 5.

TABLE 5

Shear strength values of OSB square edge butt joints

| SAMPLE STORAGE TIME (DAYS) | AVERAGE SHEAR STRENGTH (PSI) OF SAMPLES BASED ON ADHESIVE 116 | AVERAGE SHEAR STRENGTH (PSI) OF SAMPLES BASED ON ADHESIVE 117 | AVERAGE SHEAR STRENGTH (PSI) OF SAMPLES BASED ON ADHESIVE 118 |
|---|---|---|---|
| 7 | $68.2^{a}$ (59.8) | $82.9^{a}$ (52.0) | $302.5^{c}$ (222.0) |
| 28 | $63.3^{a}$ (45.7) | $161.0^{b}$ (72.8) | $378.6^{c}$ (72.7) |

Note:
numbers shown in parenthesis are standard deviation values. Each average tensile strength value is based on 20 different measurements. Any two average strength values in Table 5 that do not share a common superscript were found to be significantly ($p < 0.05$) distinct based on a two-tailed Student's 't' test [see A. S. C. Ehrenberg (1978) Data Reduction: Analyzing and Interpreting Statistical Data, John Wiley & Sons, New York, NY, p 302.].

EXAMPLE 9

An adhesive known as '121' was prepared in the following manner: A 600 mL beaker was charged with an epoxy resin known as D.E.R. 317 (48.1 g), which was produced by The Dow Chemical Company; and an epoxy hardener known as D.E.H. 52 (2.0 g), which was produced by The Dow Chemical Company. This mixture was manually stirred for about 2 minutes and then an epoxy resin known as D.E.R. 661 (50.1 g), which was produced by The Dow Chemical Company, was added to the beaker. The entire mixture was stirred and heated to a temperature of about 100° C. in order to melt and dissolve the D.E.R. 661 resin. This clear, colorless, homogenous mixture was then cooled and solidified.

An adhesive known as '122' was prepared in the following manner: A 600 mL beaker was charged with an epoxy resin known as D.E.R. 317 (85.0 g), which was produced by The Dow Chemical Company; and an epoxy hardener known as D.E.H. 52 (5.0 g), which was produced by The Dow Chemical Company. This mixture was manually stirred for about 2 minutes and then an epoxy resin known as D.E.R. 661 (10.0 g), which was produced by The Dow Chemical Company, was added to the beaker. The entire mixture was stirred and heated to a temperature of about 100° C. in order to melt and dissolve the D.E.R. 661 resin. This clear, colorless, homogenous mixture was then cooled and solidified.

An adhesive known as '123' was prepared in the following manner: A 600 mL beaker was charged with an epoxy resin known as D.E.R. 317 (40.0 g), which was produced by The Dow Chemical Company; and an epoxy resin known as D.E.R. 661 (60.0 g), which was produced by The Dow Chemical Company. This mixture was stirred and heated to a temperature of about 100° C. in order to melt and dissolve the D.E.R. 661 resin. This clear, colorless, homogenous mixture was then cooled and solidified.

An adhesive known as '124' was prepared in the following manner: A 600 mL beaker was charged with an epoxy resin known as Epon 828 (47.0 g) which was produced by Resolution Performance Products; and an epoxy hardener known as Epikure 3140 (3.0 g) which was produced by Resolution Performance Products. This mixture was manually stirred for about 2 minutes and then an epoxy resin known as Epon 1031 (50.0 g) which was produced by Resolution Performance Products, was added to the beaker. The entire mixture was stirred and heated to a temperature of about 80° C. in order to melt and dissolve the Epon 1031 resin. This clear, brown, homogenous mixture was then cooled and solidified.

An adhesive known as '125' was prepared in the following manner: A 600 mL beaker was charged with an epoxy resin known as Epon 828 (53.4 g) which was produced by Resolution Performance Products; and an epoxy hardener known as Epikure 3140 (3.4 g) which was produced by Resolution Performance Products. This mixture was manually stirred for about 2 minutes and then an epoxy resin known as Epon SU-8 (56.6 g) which was produced by Resolution Performance Products, was added to the beaker. The entire mixture was stirred and heated to a temperature of about 80° C. in order to melt and dissolve the Epon SU-8 resin. This clear, colorless, homogenous mixture was then cooled and solidified.

An adhesive known as '126' was prepared in the following manner: A 600 mL beaker was charged with an epoxy resin known as Epon 1031 (65.1 g), which was produced by Resolution Performance Products; and an epoxy resin known as Epon 828 (35.1 g) which was produced by Resolution Performance Products. The mixture was stirred manually and heated to 140° C. This mixture was then cooled to form a soft, sticky, brown solid.

An adhesive known as '127' was prepared in the following manner: A 600 mL beaker was charged with an epoxy resin known as Epon SU-8 (65.3 g), which was produced by Resolution Performance Products; and an epoxy resin known as Epon 828 (35.0 g) which was produced by Resolution Performance Products. The mixture was stirred manually and heated to 140° C. This mixture was then cooled to form a soft, sticky, colorless solid.

An OSB flooring panel which was produced by the Weyerhaeuser Company was cut into multiple sections (5"×2.5") and each of these had four square edges.

Adhesive 121 was heated to a temperature of about 120° C. and was then applied to the entire top-side surface area of OSB sections (2 count) at a spread rate of about 0.48 g/in$^2$.

Adhesive 122 was heated to a temperature of about 120° C. and was then applied to the entire top-side surface area of OSB sections (2 count) at a spread rate of about 0.42 g/in$^2$.

Adhesive 123 was heated to a temperature of about 120° C. and was then applied to the entire top-side surface area of OSB sections (2 count) at a spread rate of about 0.44 g/in$^2$.

Adhesive 124 was heated to a temperature of about 120° C. and was then applied to the entire top-side surface area of OSB sections (2 count) at a spread rate of about 0.44 g/in$^2$.

Adhesive 125 was heated to a temperature of about 120° C. and was then applied to the entire top-side surface area of OSB sections (2 count) at a spread rate of about 0.44 g/in$^2$.

Adhesive 126 was heated to a temperature of about 120° C. and was then applied to the entire top-side surface area of OSB sections (2 count) at a spread rate of about 0.44 g/in$^2$.

Adhesive 127 was heated to a temperature of about 120° C. and was then applied to the entire top-side surface area of OSB sections (2 count) at a spread rate of about 0.41 g/in$^2$.

Other OSB sections (14 count) were not treated on the top-side surface area.

All OSB sections were then stored in an undisturbed state at 20° C. and 50% relative humidity for a period of 6 days. The adhesive-treated major surface of treated OSB sections was then mated to the non-treated major surface of non-treated OSB sections. Each assembly was clamped for a period of 3 days at 20° C. and was then unclamped and cut into two notched shear block specimens (bond surface area=2.0"× 2.0"). The specimens were subjected to shear strength measurements at a displacement rate of 0.2 inch/minute. All specimens failed at the adhesive joint. The average shear strength as a function of adhesive type is shown in Table 6.

TABLE 6

Shear strength values of OSB laminate joints

| | ADHESIVE | | | | | | |
|---|---|---|---|---|---|---|---|
| | 121 | 122 | 123 | 124 | 125 | 126 | 127 |
| AVERAGE SHEAR STRENGTH (PSI) | 388[a] (37.3) | 332[a] (93.3) | 37[b] (9.8) | 80[cd] (18) | 65[c] (10) | 86[d] (4.7) | 107[cd] (47.9) |

Note:
numbers shown in parenthesis are standard deviation values. Each average tensile strength value is based on 4 different measurements. Any two average strength values in Table 6 that do not share a common superscript were found to be significantly ($p < 0.05$)distinct based on a two-tailed Student's 't' test [see A. S. C. Ehrenberg (1978) Data Reduction: Analyzing and Interpreting Statistical Data, John Wiley & Sons, New York, NY, p 302.].

EXAMPLE 10

An adhesive known as W118 was prepared in the following manner: A 600 mL beaker was charged with an epoxy resin known as Epon 1031 (260 g), which was produced by Resolution Performance Products; and an epoxy resin known as Epon 828 (140 g) which was produced by Resolution Performance Products. The mixture was stirred manually and heated to 140° C. This mixture was then cooled to form a soft, sticky, brown solid.

TJI ("Trus Joist International") 110 I-joists (flange width=1.75") were manufactured by the Weyerhaeuser Company. Adhesive W118 was heated to a temperature of about 100° C. and was then applied to the entire top surface of the upper I-joist flange at an application rate of 6-7 g/ft. The applied adhesive spontaneously cooled and solidified as a coating on the top surface of the upper I-joist flange. The solidified adhesive could easily be touched, grabbed and handled by an individual without the transfer of any of the adhesive onto the individual's hands.

The adhesive treated I-joists were used in combination with TimberStrand rim board manufactured by the Weyerhaeuser Company to make model flooring frames with the adhesive-treated I-joists spaced 24" on center and with the adhesive-treated flanges oriented on the top side of the frame. The frame was allowed to age for a period of 7 days. Next, two OSB tongue & grooved subfloor panel sections manufactured by the Weyerhaeuser Company were installed onto the I-joists in direct contact with the previously applied adhesive. The tongue & groove joint was mated in the typical fashion and the panels were mechanically attached to the I-joists by use of screws, which were spaced 6" apart from each other. This model floor system was thus comprised of a subfloor panel-to-joist joint that was connected by use of both mechanical fasteners and latent adhesive.

EXAMPLE 11

A solid-sawn lumber wall stud (#2 grade, Hem-Fir, 1.5"× 3.5" cross section dimensions) was purchased at a local lumber yard and was cut to a length of 5 feet. The term "Hem-Fir" refers to lumber that is either hemlock or white fir or any mixture of hemlock and white fir. The structural properties of these two species are quite similar, and thus, the lumber may be viewed as being interchangeable. Adhesive '121', which was described in example 9, was heated to a temperature of about 100° C. and was then applied to one of the stud surfaces that had dimensions of 1.5"×5' at an application rate of 6-7 g/ft. A section of release film known as S/1/S was produced by Griff Specialty Paper & Film and had dimensions of 1.5"×5' and was applied directly onto the freshly applied adhesive. The applied adhesive solidified as it cooled. After a simulated storage period the film was peeled away from the solidified adhesive. The solidified adhesive could easily be touched, grabbed and handled by an individual without the transfer of any of the adhesive onto the individual's hands. A section of sheetrock (0.5" thick×4'×2') was then placed directly onto the adhesive-treated surface of the wall stud and was mechanically fastened with screws that were spaced about 23" apart from each other. This model interior wall system was thus comprised of a sheetrock-to-stud joint that was connected by use of both mechanical fasteners and latent adhesive. The screws were removed from the joint at least two hours after attachment and the sheetrock was still strongly fixed to the wall stud by virtue of the latent adhesive.

EXAMPLE 12

Douglas Fir, Standard & Better, solid-sawn lumber, wall studs (1.5"×3.5"×8') were obtained at a local lumberyard. A portion of these wall studs were coated along one edge of dimensions of 1.5"×8' with molten W118 adhesive (described in Example 10) at an application rate of about 5 g/ft. The applied adhesive solidified as it cooled. The solidified adhesive could easily be touched, grabbed and handled by an individual without the transfer of any of the adhesive onto the individual's hands. The adhesive-treated wall studs were stored in an undisturbed state for a period of 7 days at a temperature of 20° C. and were then used to build wall frame models (4 count) as prescribed in ASTM E-72-02, which is a standard test method for wall racking strength [ASTM International, West Conshohocken, Pa.]. These wall frame models were built with the adhesive-treated stud faces all oriented in the same direction. OSB 7/16" roof & wall sheathing panels (4'×8') were then nailed to the adhesive-treated face of the frame in accordance with ASTM E-72-02. Thus, this model wall system was comprised of an OSB sheathing-to-stud joint that was connected by use of both mechanical fasteners and latent adhesive.

A similar set of wall models (4 count) were constructed using wall studs that were not treated with adhesive.

Both types of wall models were tested for racking strength in accordance with ASTM E72-02. Average racking strength values are shown in Table 7.

TABLE 7

Racking strength of walls

| AVERAGE RACKING STRENGTH (LB) OF WALL HAVING STUDS TREATED WITH LATENT ADHESIVE | AVERAGE RACKING STRENGTH (LB) OF CONVENTIONAL WALL |
|---|---|
| 11,100[a] (774) | 9,770[b] (686) |

Note:
numbers shown in parenthesis are standard deviation values. Each average tensile strength value is based on 4 different measurements. Any two average strength values in Table 7 that do not share a common superscript were found to be significantly ($p < 0.05$) distinct based on a two-tailed Student's 't' test [see A. S. C. Ehrenberg (1978) Data Reduction: Analyzing and Interpreting Statistical Data, John Wiley & Sons, New York, NY, p 302.].

EXAMPLE 13

OSB 7/16" roof & wall sheathing panels (4'×8') (4 count) were coated along one edge of dimensions of 7/16"×8' with molten W118 adhesive (described in Example 10) at an application rate of about 2.5 g/ft. The applied adhesive solidified as it cooled. The solidified adhesive could easily be touched, grabbed and handled by an individual without the transfer of any of the adhesive onto the individual's hands. The adhesive-treated wall sheathing panels were stored in an undisturbed state for a period of 7 days at a temperature of 20° C. and were then used to build wall models (4 count) as prescribed in ASTM E-72-02 [ASTM International, West Conshohocken, Pa.]. These wall frame models were built with the adhesive-treated panel edges in contact with each other. Thus, this model wall system was comprised of an OSB sheathing-to-OSB sheathing joint that was connected by use of a latent adhesive.

While the embodiments of the invention have been illustrated and described, as noted above, many changes can be made without departing from the spirit and scope of the invention. Accordingly, the scope of the invention is not limited by the disclosure of the embodiments. Instead, the invention should be determined entirely by reference to the claims that follow.

What is claimed is:

1. A system for attaching a plurality of wood products:

a first wood product having a first chemical compound applied to a surface of the first wood product, the first chemical compound being selected from a group consisting of resorcinol/formaldehyde novolac resin, resorcinol/formaldehyde novolac resin and ammonium chloride, resorcinol/formaldehyde/butyraldehyde novolac resin, urea/formaldehyde resin with a molar ratio of formaldehyde/urea less than 0.8 and ammonium sulfate, resorcinol/formaldehyde/butyraldehyde novolac resin, epoxy resin, multifunctional aromatic isocyanate, acrylic adhesive with chlorosulfonated polyethylene, and polydimethylsiloxane; and a second wood product having a second chemical compound applied to a surface of the second wood product, the second chemical compound being selected from a group consisting of paraformaldehyde, oxazolidine, trioxane, urea/formaldehyde resin with a molar ratio of formaldehyde/urea in excess of 1.0, melamine/formaldehyde resin with a molar ratio of formaldehyde/melamine in excess of 1.0, polyamine, polyol, aniline/butyraldehyde adduct, and tetraethoxysilane;

wherein an adduct is formed when the first chemical compound contacts the second chemical compound;

wherein the first wood product becomes adhered to the second wood product; and wherein the first chemical compound and the second chemical compound have an open assembly time greater than or approximately equal to 24 hours.

2. The system of claim 1 wherein the first chemical compound is present on the surface of the first wood product in a range from 0.1 to 30 grams per square foot.

3. The system of claim 1 wherein the first chemical compound further comprises an additive wherein the additive accounts for 0-80% of the first chemical compound.

4. The system of claim 1 wherein the first wood product has a tongue extending from at least one side and the second wood product has a groove formed within a side of the second wood product.

5. The system of claim 1 wherein the first wood product and second wood product form a joint type which is selected from a group consisting of panel-to-panel, sill plate-to-foundation, rim board-to-sill plate, rim board-to-foundation, rim board-to-joist, girder-to-joist, joist-to-rim board, joist-to-blocking, joist-to-subfloor, sill plate-to-subfloor, corner post-to-stud, sheathing-to-stud, sheetrock-to-stud, trimmer-to-stud, header-to-stud, header-to-top plate, header-to-opening trim plate, rafter stud-to-top plate, rafter-to-ridge board, rafter-to-sheathing, rafter-to-decking, and collar beam-to-rafter.

6. The system of claim 1 further comprising:

a release film on the first chemical compound.

7. The system of claim 1 wherein the first wood product comprises a material selected from a group consisting of solid-sawn wooden lumber, an engineered wood product, wood-based composite, glulam, finger-jointed lumber and metal.

8. A system for attaching a plurality of wood products comprising:

a first wood product; and a second wood product having:

a first chemical compound applied to a surface of the second wood product, the first chemical compound being selected from a group consisting of resorcinol/formaldehyde novolac resin, resorcinol/formaldehyde novolac resin and ammonium chloride, resorcinol/formaldehyde/butyraldehyde novolac resin, urea/formaldehyde resin with a molar ratio of formaldehyde/urea less than 0.8 and ammonium sulfate, resorcinol/formaldehyde/butyraldehyde novolac resin epoxy resin, multifunctional aromatic isocyanate, acrylic adhesive with chlorosulfonated polyethylene, and polydimethylsiloxane; and a second chemical compound applied to the surface of the second wood product, the second chemical compound being selected from a group consisting of paraformaldehyde, oxazolidine, trioxane, urea/formaldehyde resin with a molar ratio of formaldehyde/urea in excess of 1.0, melamine/formaldehyde resin with a molar ratio of formaldehyde/melamine in excess of 1.0, polyamine, polyol, aniline/butyraldehyde adduct, and tetraethoxysilane;

wherein the first compound is adjacent to the second compound along the surface and further wherein mixture of the first chemical compound and the second chemical compound causes formation of an adduct thereby enabling the first wood product to become adhered to the second wood product; and wherein the first chemical compound and the second chemical compound have an open assembly time greater than or approximately equal to 24 hours.

9. The system of claim 8 wherein the first chemical compound is on opposite sides of the second chemical compound.

10. The system of claim 8 wherein the first compound is in bead form.

11. The system of claim 8 wherein the first wood product and second wood product form a joint type which is selected from a group consisting of panel-to-panel, sill plate-to-foundation, rim board-to-sill plate, rim board-to-foundation, rim board-to-joist, girder-to-joist, joist-to-rim board, joist-to-blocking, joist-to-subfloor, sill plate-to-subfloor, corner post-to-stud, sheathing-to-stud, sheetrock-to-stud, trimmer-to-stud, header-to-stud, header-to-top plate, header-to-opening trim plate, rafter stud-to-top plate, rafter-to-ridge board, rafter-to-sheathing, rafter-to-decking, and collar beam-to-rafter.

12. The system of claim 8 wherein the first chemical compound is present on the surface of the second wood product in a range from 0.1 to 30 grams per square foot.

13. The system of claim 8 wherein the first wood product has a tongue extending from at least one side and the second wood product has a groove formed within a side.

14. A system for attaching a plurality of wood products:

a first wood product having a first chemical compound applied to a surface of the first wood product in a range of 0.1 to 30 grams per square foot, the first chemical compound being selected from a group consisting of resorcinol/formaldehyde novolac resin, resorcinol/formaldehyde novolac resin and ammonium chloride, resorcinol/formaldehyde/butyraldehyde novolac resin, urea/formaldehyde resin with a molar ratio of formaldehyde/urea less than 0.8 and ammonium sulfate, resorcinol/formaldehyde/butyraldehyde novolac resin, epoxy resin, multifunctional aromatic isocyanate, acrylic adhesive with chlorosulfonated polyethylene, and polydimethylsiloxane; and a second wood product having a second chemical compound applied to a surface of the second wood product, the second chemical compound being selected from a group consisting of paraformaldehyde, oxazolidine, trioxane, urea/formaldehyde resin with a molar ratio of formaldehyde/urea in excess of 1.0, melamine/formaldehyde resin with a molar ratio of formaldehyde/melamine in excess of 1.0, polyamine, polyol, aniline/butyraldehyde adduct, and tetraethoxysilane;

wherein an adduct is formed when the first chemical compound contacts the second chemical compound wherein the first wood product becomes adhered to the second wood product;

wherein the first chemical compound and the second chemical compound have an open assembly time greater than or approximately equal to 24 hours;

and wherein the first wood product has a tongue extending from at least one side of the first wood product and the second wood product has a groove formed within a side of the second wood product.

15. The system of claim 14 wherein the first wood product and second wood product form a joint type which is selected from a group consisting of panel-to-panel, sill plate-to-foundation, rim board-to-sill plate, rim board-to-foundation, rim board-to-joist, girder-to-joist, joist-to-rim board, joist-to-blocking, joist-to-subfloor, sill plate-to-subfloor, corner post-to-stud, sheathing-to-stud, sheetrock-to-stud, trimmer-to-stud, header-to-stud, header-to-top plate, header-to-opening trim plate, rafter stud-to-top plate, rafter-to-ridge board, rafter-to-sheathing, rafter-to-decking, and collar beam-to-rafter.

16. The system of claim 14, further comprising a release film on the first chemical compound.

* * * * *

UNITED STATES PATENT AND TRADEMARK OFFICE

CERTIFICATE OF CORRECTION

PATENT NO. : 7,726,085 B2
APPLICATION NO. : 11/192734
DATED : June 1, 2010
INVENTOR(S) : Jack G. Winterowd et al.

It is certified that error appears in the above-identified patent and that said Letters Patent is hereby corrected as shown below:

Col. 20, Line 58, claim 8 should read as follows:

... butyraldehyde novolac resin, epoxy resin, multifunc- ...

A --,-- needs to be inserted between the words "resin" and "epoxy".

Signed and Sealed this

Thirteenth Day of July, 2010

David J. Kappos

David J. Kappos
*Director of the United States Patent and Trademark Office*